US011613867B2

(12) United States Patent
Visser et al.

(10) Patent No.: US 11,613,867 B2
(45) Date of Patent: Mar. 28, 2023

(54) LOCKING ASSEMBLY

(71) Applicant: Aqseptence Group Pty Ltd, Queensland (AU)

(72) Inventors: Denys Visser, Queensland (AU); Aaron Robert Christopher, Queensland (AU); Andrew Raymond White, Queensland (AU)

(73) Assignee: Aqseptence Group Pty Ltd., Queensland (AU)

( * ) Notice: Subject to any disclaimer, the term of this patent is extended or adjusted under 35 U.S.C. 154(b) by 107 days.

(21) Appl. No.: 17/076,366

(22) Filed: Oct. 21, 2020

(65) Prior Publication Data

US 2021/0123205 A1 Apr. 29, 2021

(30) Foreign Application Priority Data

Oct. 23, 2019 (AU) ..... 2019253846

(51) Int. Cl.
*E02D 29/14* (2006.01)

(52) U.S. Cl.
CPC ..... *E02D 29/1427* (2013.01); *E02D 29/1454* (2013.01)

(58) Field of Classification Search
CPC ... E02D 29/1427; E02D 29/14; E05B 65/006; Y10T 70/5549; Y10T 70/5553; Y10T 70/5558; Y10T 70/5562; Y10T 70/558; Y10T 70/5584; Y10T 70/5589; Y10T 70/5597; Y10T 70/5602; Y10T 70/5606
USPC ..... 52/20
See application file for complete search history.

(56) References Cited

U.S. PATENT DOCUMENTS 5,987,824 A * 11/1999 Fuller ..... E02D 29/14 404/25
8,347,670 B2 * 1/2013 Rix ..... E05B 35/008 70/164
8,763,838 B2 * 7/2014 Procunier ..... B65D 51/243 70/168
9,021,842 B2 * 5/2015 Rix ..... E05B 65/0089 70/164

(Continued)

FOREIGN PATENT DOCUMENTS

CN 111305274 A * 6/2020 ..... E02D 29/1418
GB 556870 A * 10/1943

(Continued)

*Primary Examiner* — Frederick L Lagman
(74) *Attorney, Agent, or Firm* — Patterson Thuente IP

(57) ABSTRACT

A locking assembly is provided for a cover. The cover is a substantially rigid cover configured to close off an opening to a void, said void bounded by a side wall. The cover defines a top side and an opposed underside. The locking assembly includes a mounting arrangement mountable to the underside. A link is pivotally connected to the mounting arrangement. The link defines a first end and a second, free end. A locking member is carried by the second, free end of the link. The locking member frictionally engages the side wall of the void in a locking position, in use. An actuating member connects to the link and is accessible via the top side. The actuating member displaces the link relative to the mounting arrangement to cause the locking member to frictionally disengage from the side wall of the void to a disengaged position.

15 Claims, 4 Drawing Sheets

(56) References Cited

U.S. PATENT DOCUMENTS

| | | | | |
|---|---|---|---|---|
| 2011/0203334 | A1* | 8/2011 | Rix | E05B 61/00 70/391 |
| 2015/0048634 | A1* | 2/2015 | Gauntt | E05B 35/008 292/338 |
| 2016/0333609 | A1* | 11/2016 | VanDeMark | E05B 65/006 |
| 2017/0226714 | A1* | 8/2017 | Mitola | E02D 29/1481 |

FOREIGN PATENT DOCUMENTS

| | | | | |
|---|---|---|---|---|
| GB | 2302117 | * | 1/1997 | E02D 29/1418 |
| WO | WO-2007128047 | A1 * | 11/2007 | E02D 29/1418 |
| WO | WO-2008055283 | A1 * | 5/2008 | E02D 29/1409 |

* cited by examiner

LOCKING ASSEMBLY

CROSS-REFERENCE TO RELATED APPLICATIONS

This application claims the benefit of priority of AU Application No. 2019253846, filed 23 Oct. 2019, the contents of which are incorporated herein by reference in their entirety.

TECHNICAL FIELD

The present disclosure relates, generally, to a locking assembly, and, more particularly, to a locking assembly for a cover. The disclosure has particular, but not necessarily exclusive, application to a pit cover locking assembly.

BACKGROUND

Covers are used as barriers to prevent inadvertent or unauthorised entry into voids, passages, pits, and the like. To prevent unauthorised entry, these covers must be secured such that an unauthorised person is not able to remove the cover. In addition, covers applied to pits or manholes housing electrical equipment may be susceptible to being violently displaced by explosions or other powerful electrical discharges applying strong upward forces caused by faulty wiring or release of explosive gases in the pits or manholes. Such displacement could result in serious injuries or fatalities.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

In an aspect of the present disclosure, there is provided a locking assembly for a cover, the cover being a substantially rigid cover and configured to close off an opening to a void, the void being bounded by a side wall and the cover defining a pair of opposed sides, being an operatively top side and an opposed underside, the locking assembly comprising: a mounting arrangement mountable to the underside of the cover; a link pivotally connected to the mounting arrangement, the link defining a first end and a second, free end; a locking member carried by the second, free end of the link, the locking member being configured to frictionally engage with the side wall of the void in a locking position, in use; and an actuating member connected to the link and accessible via the operatively top side of the cover, the actuating member being operable to displace the link relative to the mounting arrangement to cause the locking member to frictionally disengage from the side wall of the void to a disengaged position.

The actuating member may be connected to the link intermediate the first end and the second end.

The link may be pivotally connected to the mounting arrangement at the first end.

The locking member may be pivotally connected to the second end of the link.

The actuating member may be at least pivotally connected to the link. In an embodiment, the actuating member may be connected to the link such that the actuating member is able to pivot and be displaced slidably relative to the link.

The actuating member may carry a stop member, the stop member being configured to abut the underside of the cover during operation of the actuating member.

The actuating member may be dimensioned to receive a tool inserted via the operatively top side of the cover, and the actuating member may be operable, by using the tool, to displace the actuating member substantially orthogonally relative to the top side of the cover, by applying a force to the link and frictionally disengaging the locking member from the side wall.

The locking member may comprise a friction pad configured to frictionally engage with the side wall.

The link may comprise a plurality of link arms arranged in spaced, parallel relationship.

In another aspect of the present disclosure, there is provided a cover which includes a cover member; and the locking assembly, as described above, carried by the cover member.

The cover member may be vented. The cover member may comprise a support arrangement and a plurality of elongate elements arranged at spaced intervals on the support arrangement, the spacing of the elongate elements providing the venting. Each elongate element may be of metal.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments of the disclosure will now be described by way of example only with reference to the accompany drawings in which.

DETAILED DESCRIPTION OF EXEMPLARY EMBODIMENTS

Figure 1:
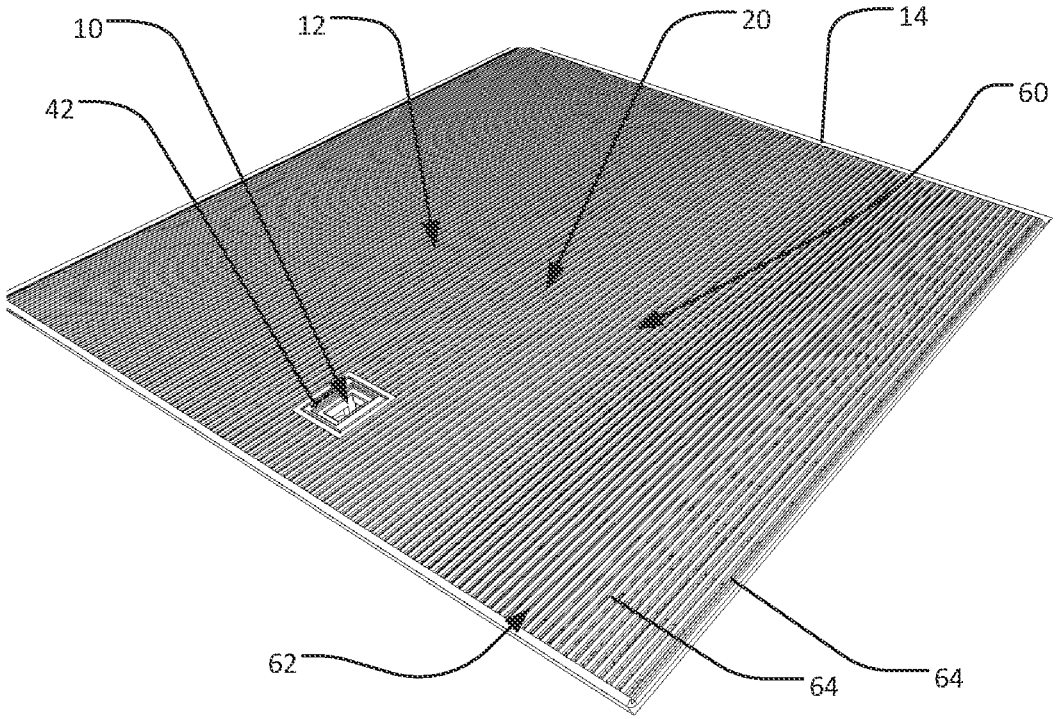
FIG. 1 shows a perspective view of an operatively top side of a cover including an embodiment of a locking assembly for a cover.
Figure 2:
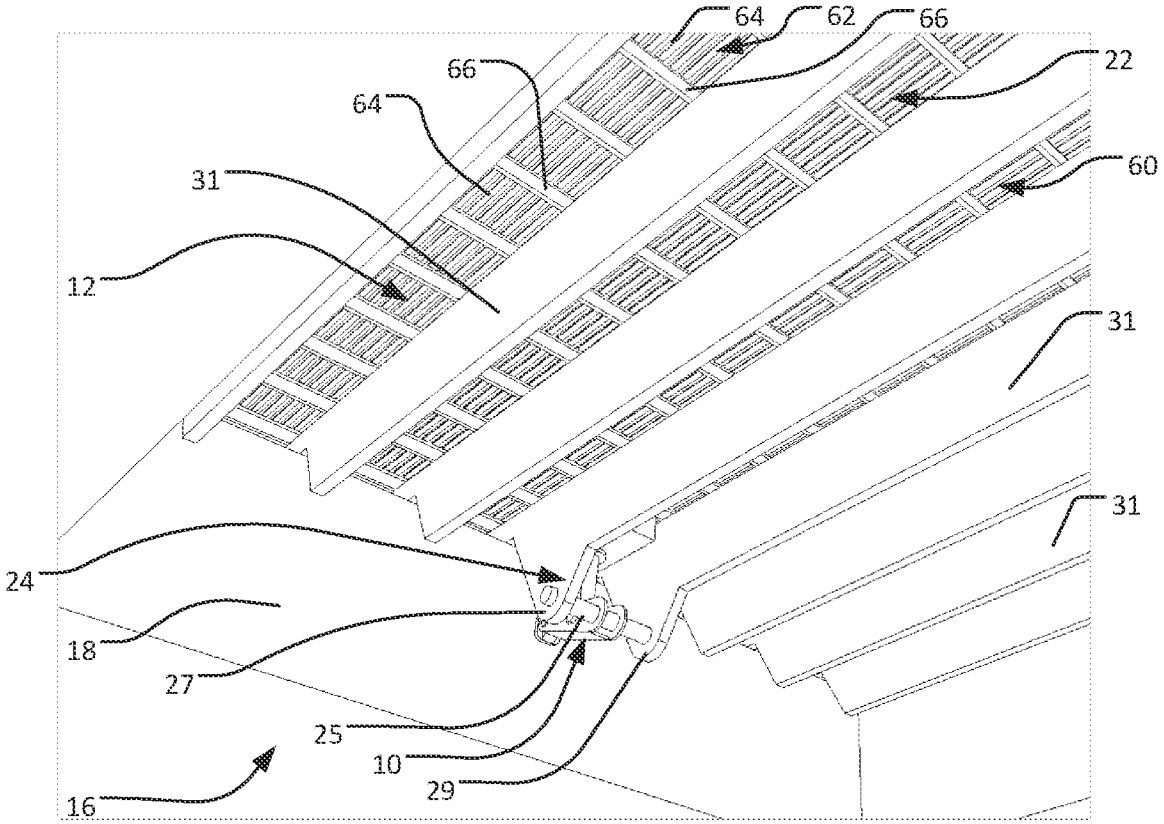
FIG. 2 shows a perspective view of an opposed underside of the cover shown in FIG. 1 including the locking assembly.
Figure 3:
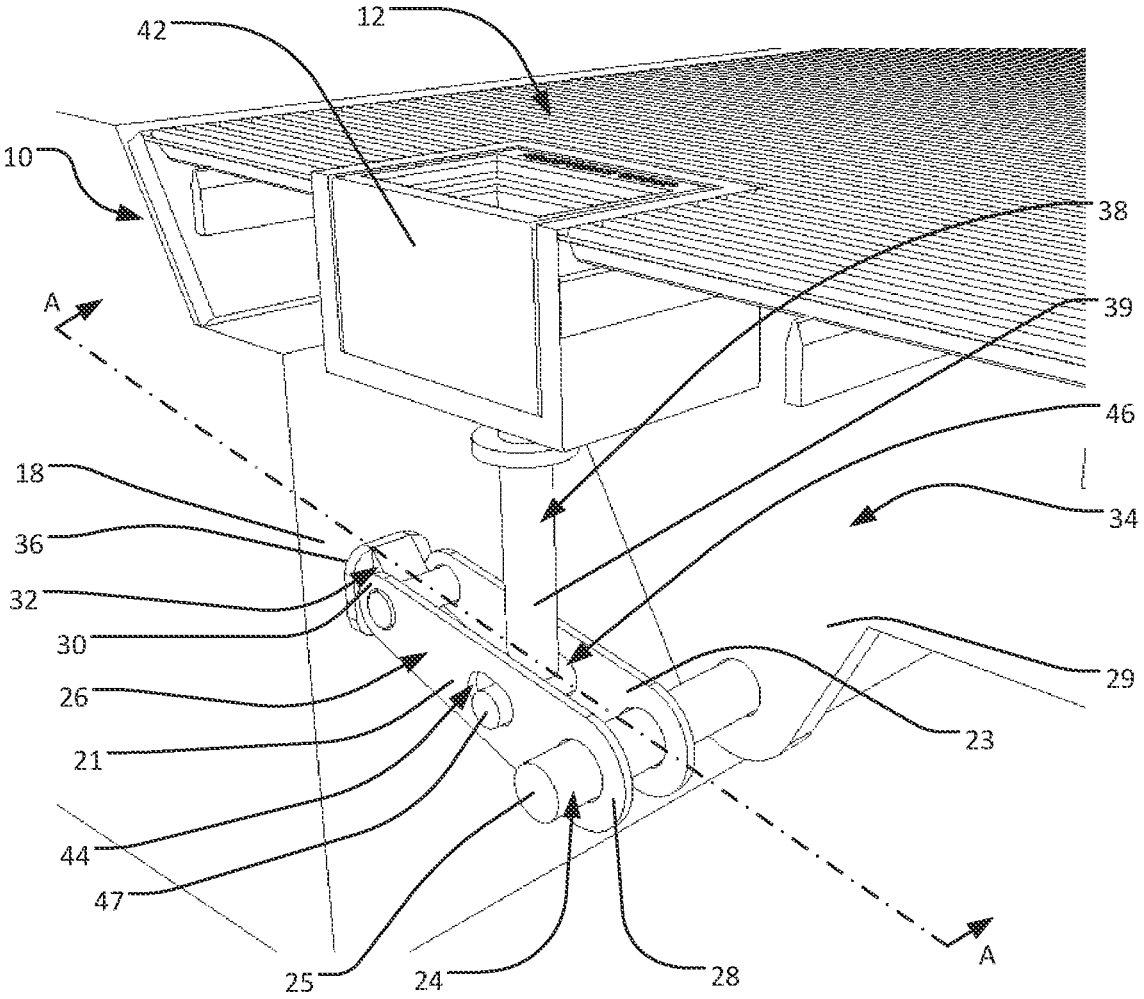
FIG. 3 shows, on an enlarged scale, a sectional, perspective view of the cover and the locking assembly.
Figure 4:
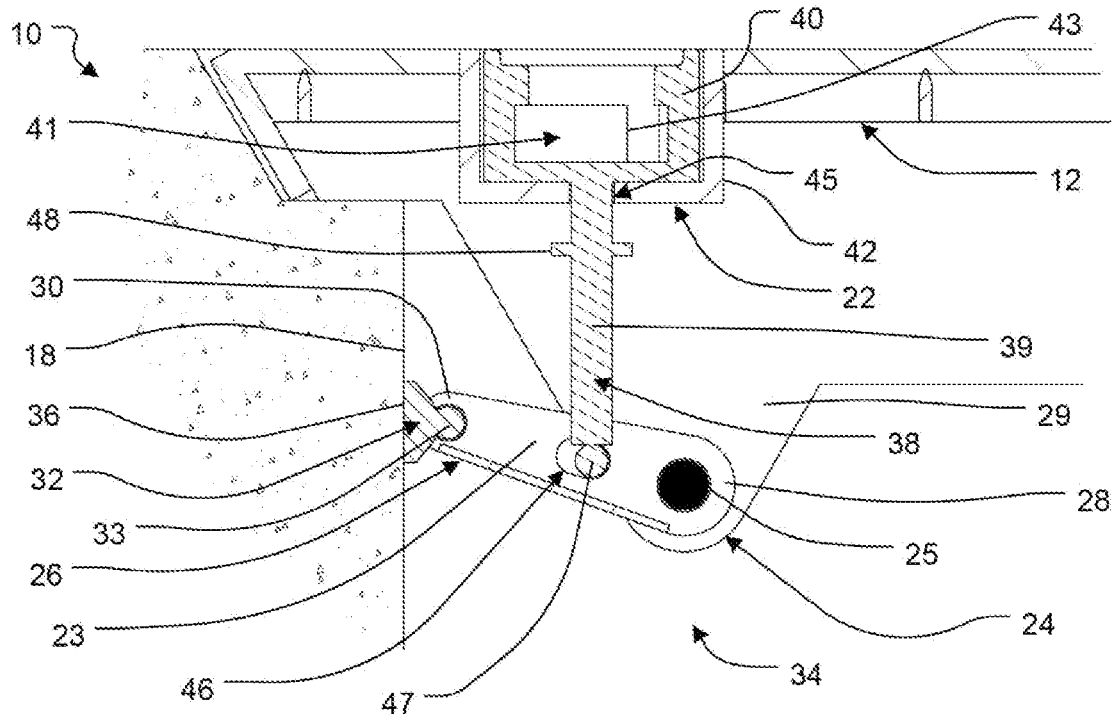
FIGS. 4 and 7 show a sectional side view of the locking assembly taken along lines A-A in FIG. 3.

In the drawings, reference numeral 10 generally designates a locking assembly for a cover 12. The cover 12 is a substantially rigid cover 12 and is configured to close off an opening 14 to a void 16. The void 16 is bounded by a side wall 18 and the cover 12 defines a pair of opposed sides, being an operatively top side 20 (FIG. 1) and an opposed underside 22 (FIG. 2). In the exemplary embodiment, the void 16 is in the form of a pit or manhole 16 and the cover 12 is in the form of a pit cover or manhole cover 12.

The locking assembly 10 includes a mounting arrangement 24 mountable to the underside 22 of the cover 12 (FIGS. 2-6). The mounting arrangement 24 comprises a pair of laterally spaced flanges 27, 29 projecting from the underside 22 of the cover 12. The locking assembly 10 further includes a link 26 pivotally connected between the flanges 27, 29 of the mounting arrangement 24, the link 26 defining a first end 28 and a second, free end 30.

The link 26 comprises a pair of laterally spaced link arms 21, 23, though it will be appreciated that a single link arm may be provided in alternate embodiments. The link 26 is pivotally connected to the mounting arrangement 24 by a mounting pin 25 of the mounting arrangement 24 arranged at the first end 28 of the link 26. The mounting pin 25 is held fast between the flanges 27, 29 of the mounting arrangement 24. It will be appreciated that the link 26 may pivotally receive the mounting pin 25 at various points or positions along the link 26. The mounting pin 25 defines a pivot axis about which the link 26 is pivotally connected to the mounting arrangement 24.

Each of the flanges 27, 29 is formed integrally, as a one piece element, with a rib 31 carried on the underside 22 of the cover 12. It will be appreciated that the mounting arrangement 24 can take various forms, such as, for example, the exclusion of the pair of flanges 27, 29, thereby having the mounting pin 25 received within at least one of the ribs 31 or between two of the ribs 31.

The locking assembly 10 further includes a locking member 32 (FIGS. 3-6) carried by the second, free end 30 of the link 26. The locking member 32 is configured to frictionally engage with the side wall 18 of the pit 16 in a locking position 34, in use. The locking member 32 includes a friction pad 36 configured to frictionally engage with the side wall 18. A pivot pin 33 is integrally formed with the friction pad 36 as a one piece element. The pivot pin 33 is pivotally received between the link arms 21, 23 of the link 26. It will be appreciated that, in alternate embodiments, the locking member 32 may be fixedly arranged relative to the link 26 via appropriate fabrication with the link 26, welding, adhesion, or the like.

The locking assembly 10 further includes an actuating member 38 (FIGS. 3-6) connected to the link 26 and accessible via the operatively top side 20 of the cover 12. The actuating member 38 is operable to displace the link 26 relative to the mounting arrangement 24 to cause the friction pad 36 of the locking member 32 to frictionally disengage from the side wall 18 of the pit 16 as a result of which a further upward force on the actuating member 38 results in raising of the cover 12 as will be described in greater detail below.

The cover 12 includes a receptacle 42 projecting from the underside 22 of the cover 12 into the pit 16, in use. The receptacle 42 defines a recess in which a housing 40 of the actuating member is displaceably received. The housing 40 of the actuating member 38 is accessible via the operatively top side 20 of the cover 12. The actuating member 38 includes a shaft 39 extending from an operatively under side of the housing 40 and through an aperture 45 in a floor of the receptacle 42 of the cover 12.

A free end of the shaft 39 carries a transversely extending pin 47. Ends of the pin 47 are held captive in slots 44, 46 defined in the link arms 21, 23, respectively, of the link 26. The pin 47 is thus able to pivot and be displaced slidably relative to the link 26 via the ends of the pin 47 being received in the slots 44, 46. The length of the slots 44, 46 is dependent on the geometry of the locking assembly 10 and, the closer the pin 47 is to the mounting pin 25, the shorter the slots 44, 46 can be. Thus, it will be appreciated that, in some embodiments, the actuating member 38 may only be pivotable relative to the link 26.

The housing 40 of the actuating member 38 defines a socket 41 accessible via the operatively top side 20 of the cover 12. The socket 41 is dimensioned to receive a lifting tool (not shown) inserted via the operatively top side 20 of the cover 12. The lifting tool is of the type having a T-shaped end that, once received in the socket 41 of the housing 40, is rotated by 90° to be received, in a locking and lifting orientation in opposed recesses 43 defined in the side wall of the housing 40. This then allows the lifting tool to be used to operate the actuating member 38 in an authorised manner and, in so doing, raising the cover 12 from the opening of the pit 16.

The actuating member 38 also carries a stop member, in the form of a collar 48, fixed to the shaft 39 of the actuating member 38 and configured to abut an operatively outer surface of a bottom of the receptacle 42. The collar 48 restricts movement of the actuating member 38 relative to the receptacle 42 of the cover 12 during operation of the actuating member 38 and facilitates raising of the cover 12 from the opening of the pit 16. The collar 48 is fixed to the shaft 39 by welding but, in other embodiments, could be formed with the shaft 39 integrally as a one piece element. In other embodiments the stop member could be a split pin, a pair of lock nuts, or the like.

The cover 12 is vented and is in the form of a metal grate. More particularly, the cover 12 comprises a cover member 60 comprising a support arrangement 62 and a plurality of elongate elements 64 arranged at spaced intervals on the support arrangement 62, the spacing of the elongate elements 64 providing the venting.

The support arrangement 62 includes a plurality of spaced support bars 66 (FIG. 2) orthogonally overlying a plurality of the spaced ribs 31. The elongate elements 64 are provided, in turn, orthogonally over the support bars 66 to define the vented grate. Each elongate element may, conveniently, be in the form of a length of Vee-Wire °. (Vee-Wire is a Registered Trade Mark of Johnson Screens, Inc., of 2000 St. James Place, Houston, Tex., 77056, USA.).

An angle θ is defined between an axis 200 along which a distance between the pivot axis 25 and the top cover 12 is a minimum and an axis 300 extending between the first 28 and second 30 ends of the link 26. In the locking position, angle θ is a first acute angle. In the disengaged position, angle θ is a second acute angle that is smaller than the first acute angle.

Figure 5:
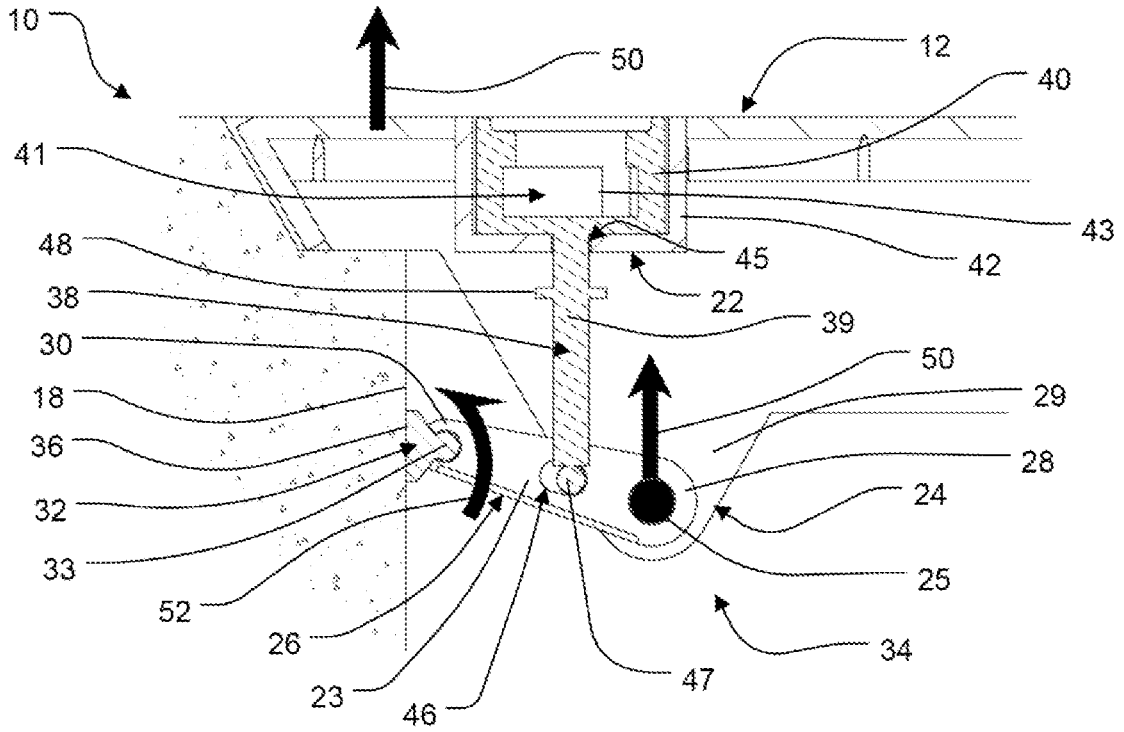
FIG. 5 shows a sectional side view of the locking assembly illustrating forces applied to the locking assembly arising from an unauthorised attempt to displace the cover.
Figure 6:
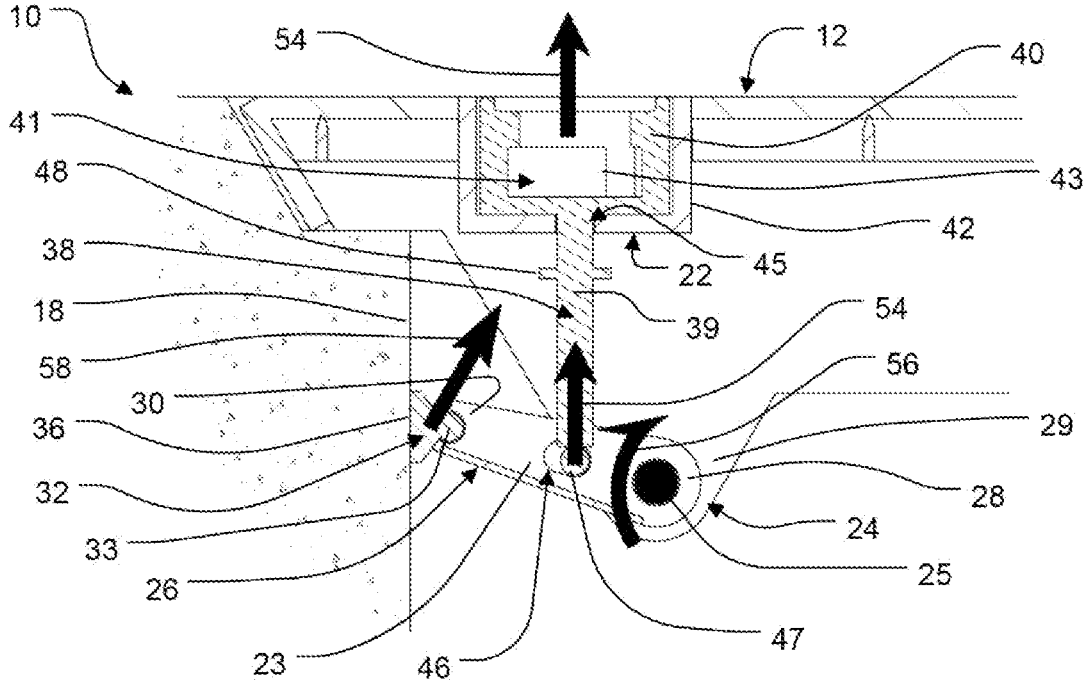
FIG. 6 shows a sectional side view of the locking assembly illustrating forces applied to the locking assembly arising from the use of an authorised lifting device to displace or remove the cover.
Figure 7:
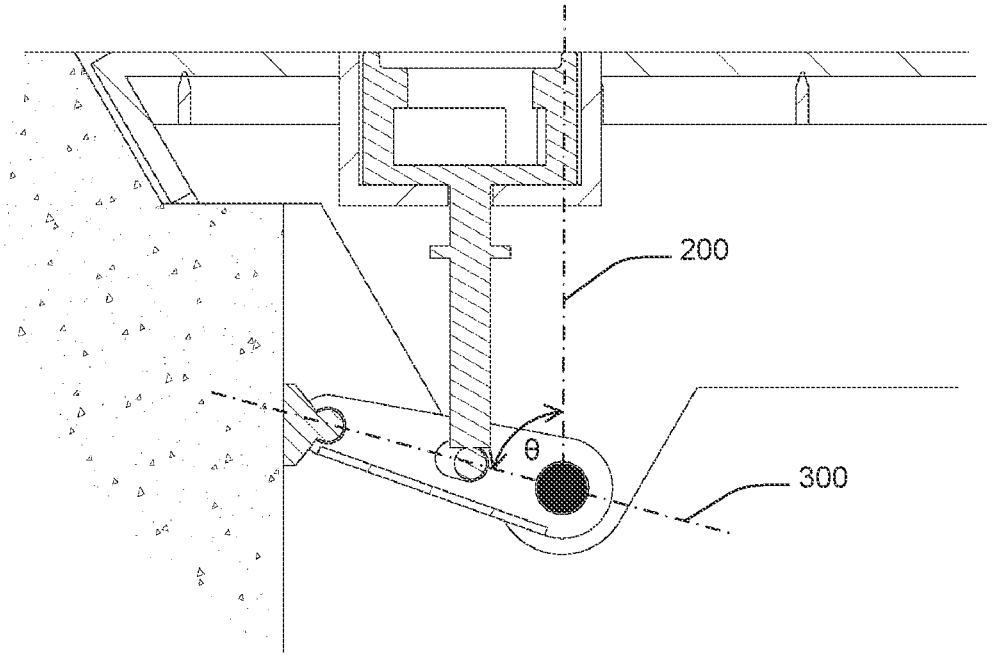

FIGS. 5 and 6 show the locking assembly 10 in use. When an attempt is made to lift the cover 12, with the installed locking assembly 10, using a lifting force 50 via any means other than by operating the actuating member 38, the lifting force 50 is transferred to the mounting pin 25 of the mounting arrangement 24 as shown in FIG. 5. The frictional engagement between the friction pad 36 of the locking member 32 and the side wall 18 of the pit 16 increases and, as a result, inhibits frictional disengagement of the friction pad 36 of the locking member 32 from the side wall 18 of the pit 16, effectively locking the cover 12 in place. This arises due to the link 26 rotating relative to the substantially stationary locking member 32 causing an anticlockwise moment 52 about the pivot pin 33 of the locking member 32. The link 26 is dimensioned such that, as the link 26 rotates about the pivot pin 33, the force applied to the side wall 18 by the friction pad 36 increases, thus strengthening the frictional engagement between the friction pad 36 and the side wall 18 and further securing the locking position 34.

To remove the cover 12 in an authorised manner, the lifting tool is inserted into the socket 41 of the housing 40 and is rotated through 90° to engage the opposed recesses 43 of the housing 40. Pulling on the lifting tool thus raises the actuating member 38 substantially orthogonally relative to the top side 20 of the cover 12, as shown by force arrow 54. Raising the shaft 39 of the actuating member 38 in the direction of the arrow 54, causes a clockwise moment 56 about the mounting pin 25 of the mounting arrangement 24. This causes a releasing force 58 to be applied at the locking member 32 in a direction away from the side wall 18 of the pit 16 which, in turn, causes the friction pad 36 of the locking member 32 to frictionally disengage from the side wall 18. Further upward movement of the shaft 39 of the actuating member 38 causes the ends of the pin 47 to slide in the slots 44, 46 of the link arms 21, 23 of the links releasing the locking member 32 fully from the side wall. The collar 48 eventually abuts the bottom of the receptacle 42 of the cover 12 allowing the cover 12 to be lifted out of the opening of the pit 16 the lifting tool.

It will be appreciated that, in alternate embodiments, the actuating member 38 may be connected between the first end 28 of the link 26 and the mounting pin 25 so that the mounting pin 25 is arranged intermediate the mounting of the actuating member 38 to the link 26 and the locking member 32. In this configuration, the required force 54 applied to the actuating member 38 by using the tool, must be applied in an operatively downward direction to cause the link 26 to rotate relative to the mounting pin 25 of the mounting arrangement 24 to move the locking assembly 10 to the disengaged position.

Advantageously, the likelihood of success of unauthorised persons attempting to gain access to the pit 16 by attempting to lift the cover 12 will be reduced due to the lifting force 50 being transferred to the mounting arrangement 24, thereby maintaining the frictional engagement between the locking member 32 and the side wall 18 of the pit 16. In some embodiments, this frictional engagement is further strengthened by the unauthorised persons applying the lifting force 50 and causing the anticlockwise moment 52 applied at the locking member 32 to increase, thereby further reducing the likelihood of the unauthorised persons removing the cover 12. It is an aim of the present disclosure that only authorised users using the lifting tool to apply the lifting force 54 to the actuating member 38 will be able to cause the locking assembly 10 to move to the disengaged position, thereby allowing such authorised users to lift the cover 12 to gain access to the pit 16. In this way, the locking assembly 10 reduces occurrences of unauthorised entry into voids such as pits, manholes, passages, and the like.

Further, since the cover 12 is vented, potentially explosive gases are able to escape to atmosphere minimising the chances of explosions causing the cover 12 to be blown off the pit 16. The locking member 32 will, however, assist in retaining the cover 12 in position in the event of unexpected disturbances of the cover 12 from beneath the cover 12.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A locking assembly for a cover, the cover being a substantially rigid cover and configured to close off an opening to a void, the void being bounded by a side wall and the cover defining a pair of opposed sides, being an operatively top side and an opposed underside, the locking assembly comprising:

a mounting arrangement mountable to the underside of the cover;

a link pivotally connected to the mounting arrangement about a pivot axis, the link defining a first end and a second, free end;

a locking member carried by the second, free end of the link, the locking member being configured to frictionally engage with the side wall of the void in a locking position, in use; and an actuating member connected to the link and accessible via the operatively top side of the cover, the actuating member being operable to displace the link relative to the mounting arrangement to cause the locking member to frictionally disengage from the side wall of the void to a disengaged position, wherein in the locking position, a first acute angle is defined between:

an axis along which a distance between the pivot axis and the top cover is a minimum; and an axis extending between the first and second ends of the link.

2. The locking assembly according to claim 1, wherein the actuating member is connected to the link intermediate the first end and the second end.

3. The locking assembly according to claim 1, wherein the link is pivotally connected to the mounting arrangement at the first end.

4. The locking assembly according to claim 1, wherein the locking member is pivotally connected to the second end of the link.

5. The locking assembly according to claim 4 in which the actuating member is connected to the link such that the actuating member is able to pivot and be displaced slidably relative to the link.

6. The locking assembly according to claim 1, wherein the actuating member is at least pivotally connected to the link.

7. The locking assembly according to claim 1, wherein the actuating member carries a stop member, the stop member being configured to abut the underside of the cover during operation of the actuating member.

8. The locking assembly according to claim 1, wherein the actuating member is dimensioned to receive a tool inserted via the operatively top side of the cover, and wherein the actuating member is operable, by using the tool, to displace the actuating member substantially orthogonally relative to the top side of the cover, by applying a force to the link and frictionally disengaging the locking member from the side wall.

9. The locking assembly according to claim 1, wherein the locking member comprises a friction pad configured to frictionally engage with the side wall.

10. The locking assembly according to claim 1, wherein the link comprises a plurality of link arms arranged in spaced, parallel relationship.

11. The locking assembly according to claim 1, wherein, in the disengaged position, a second acute angle is defined between:

the axis along which a distance between the pivot axis and the top cover is a minimum; and the axis extending between the first and second ends of the link, the second acute angle being smaller than the first acute angle.

12. A cover which includes a cover member; and the locking assembly, according to claim 1, carried by the cover member.

13. The cover of claim 12 in which the cover member is vented.

14. The cover of claim 13 in which the cover member comprises a support arrangement and a plurality of elongate elements arranged at spaced intervals on the support arrangement, the spacing of the elongate elements providing the venting.

15. The cover of claim 14 in which each elongate element is of metal.

* * * * *